United States Patent [19]

Miyakawa

[11] Patent Number: 4,679,945

[45] Date of Patent: Jul. 14, 1987

[54] TIMEPIECE

[76] Inventor: Masao Miyakawa, 15 Aza-ohzukiibu-cho, Toriya-machi, Kashima-gun 929-17, Ishikawa, Japan

[21] Appl. No.: 881,907

[22] Filed: Jul. 3, 1986

[51] Int. Cl.[4] ..... G04B 19/04

[52] U.S. Cl. ..... 368/238; 368/228

[58] Field of Search ..... 328/223–238

[56] References Cited

U.S. PATENT DOCUMENTS 1,807,497 5/1931 Speciale ..... 368/228

1,847,800 3/1932 Weil ..... 368/228

1,851,824 3/1932 Fewell ..... 368/228

*Primary Examiner*—Bernard Roskoski

*Attorney, Agent, or Firm*—Marshall, O'Toole, Gerstein, Murray & Bicknell

[57] ABSTRACT

This disclosure relates to a timepiece comprising a rotatable hour hand, a rotatable minute hand, and drive means connected to rotate the hour hand 30° for each hour and connected to rotate the minute hand 390° for each hour. The hour and minute hands thereby overlap at zero minute and zero second of each hour. The timepiece may further include an hour dial and a minute dial which is connected to the hour hand and rotates relative to the hour dial.

5 Claims, 9 Drawing Figures

3:00

6:00

12:00

3:30

6:45

TIMEPIECE

FIELD AND BACKGROUND OF THE INVENTION

The present invention relates to a new analogue timepiece which indicates the time of day by means of the angle of the minute hand relative to the hour hand which forms a reference.

There has been a tendency to produce timepieces in a wide variety of designs in recent years, and various designs have been marketed. In the conventional analogue timepiece, the ratio of rotation of the minute hand to the hour hand is set at 12 and 1, and at zero minute and zero second of every hour, the minute hand is located at the 12 o'clock point; the hour hand indicates the correct hour of day (indication from 1 to 12 hours) on a dial which is marked in the clockwise direction with 1 to 12 hour positions at intervals of 30 degrees, with the 12 hour position located at the top. In other words, the minute hand is arranged to rotate 360 degrees and the hour hand 30 degrees in each hour.

In the conventional timepiece, therefore, with the 12 hour position being the reference point, the hour hand departs from the minute hand by 30 degrees for each hour.

BRIEF SUMMARY OF THE INVENTION

A timepiece according to the invention comprises an hour hand, a minute hand, an hour dial and a minute dial. The hour hand rotates 30° for each hour and the minute hand rotates 390 degrees for each hour, so that the hour hand and the minute hand overlap at zero minute and zero second of every hour. The dial for the minutes preferably rotates integrally with the hour hand.

DETAILED DESCRIPTION

Figure 1:
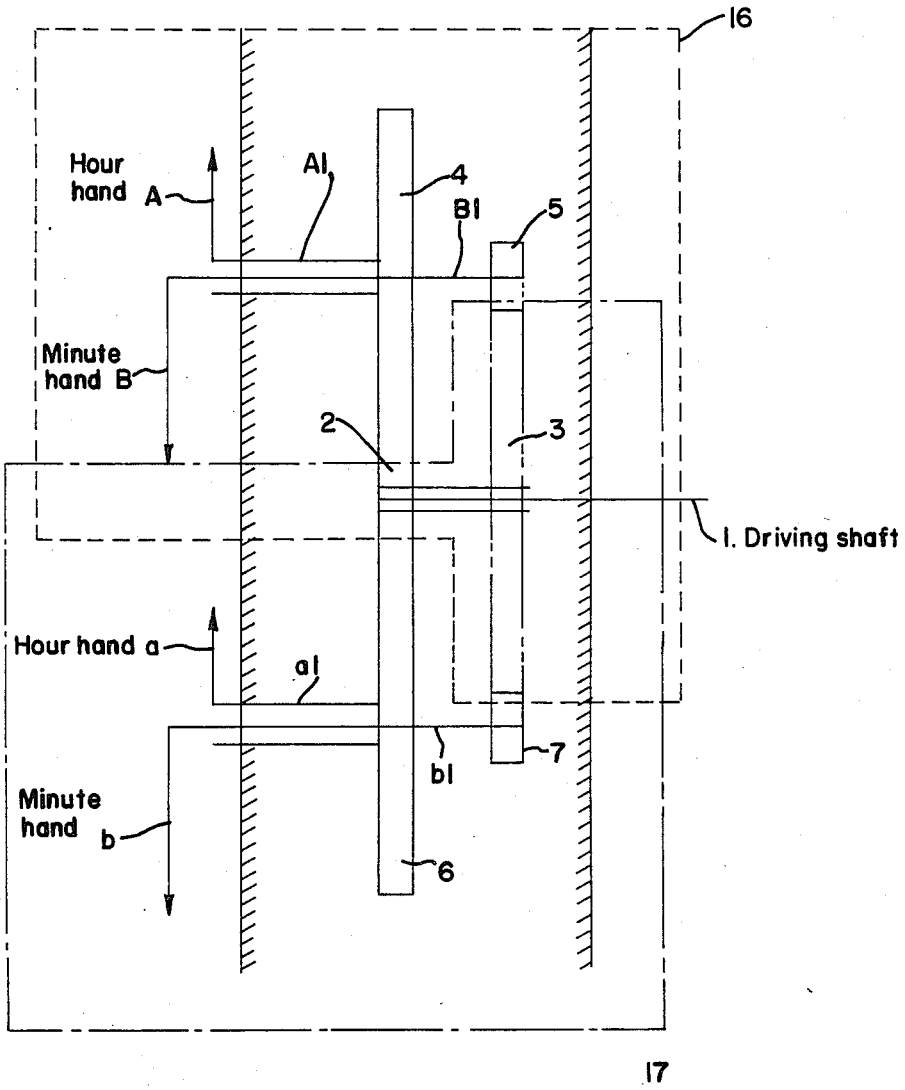
FIG. 1 is a schematic diagram showing the differences in gear ratios between a timepiece according to the present invention and a conventional timepiece.

FIG. 1 is a diagram which schematically shows the difference between the ratios of the numbers of teeth of a timepiece according to a present invention and a conventional timepiece, wherein the portion enclosed by the upper dashed line 16 is a timepiece according to the present invention, and the portion enclosed by the lower dash-dot line 17 is a conventional timepiece.

In FIG. 1, the numeral 1 denotes a primary drive shaft. A small driving gear or toothed wheel 2 having 16 teeth and a large driving toothed wheel 3 having 52 teeth are coaxially fixed to the driving shaft 1. The numeral 4 denotes a large toothed wheel for driving the hour hand A of the timepiece of this invention, and it has 48 teeth. The toothed wheel 4 meshes with the small driving toothed wheel 2, and the hour hand A is mounted on the large toothed wheel 4 via a hollow support shaft A1 so that the hour hand A integrally rotates with the large toothed wheel 4. The numeral 5 denotes a small toothed wheel for driving the minute hand B of the present invention, and it has 12 teeth. The small toothed wheel 5 meshes with the large toothed wheel 3, and the minute hand B is fastened to the small toothed wheel 5 via a support shaft B1 so that the minute hand B integrally rotates with the small toothed wheel 5.

On the other hand, the numeral 6 denotes a large toothed wheel for driving the hour hand a of the conventional timepiece, and it has 48 teeth. The large toothed wheel 6 engages with the small driving toothed wheel 2, and the hour hand a is fastened to the large toothed wheel 6 via a hollow support shaft a1 so that the hour hand a integrally rotates with the large toothed wheel 6. Numeral 7 denotes a small toothed wheel for driving the minute hand b of the conventional timepiece, and it has 13 teeth. The small toothed wheel 7 meshes with the large toothed wheel 3, and the minute hand b is mounted to the small toothed wheel 7 so that the hour hand b integrally rotates with the small toothed wheel 7.

Accordingly, when the driving shaft 1 is rotated (by a motor or other means, not shown) counterclockwise at the rate of 90 degrees per one hour, both hour hand A of the present invention and hour hand a of the prior art will rotate clockwise by 30 degrees (90 degrees$\times$16/48) through the large toothed wheels 4 and 6. However, the minute hand B of the present invention will rotate clockwise by 390 degrees (90 degrees$\times$52/12) through the small toothed wheel 5. At the same time, the minute hand b of the prior art will rotate clockwise by 360 degrees (90 degrees$\times$52/13) through the small toothed wheel 7.

Thus, in the timepiece of the present invention, the ratio of rotation of the hour hand A to the minute hand B is 1 to 13, and the gear ratios are set so that the hour hand A rotates 30 degrees and the minute hand B rotates 390 degrees for each hour.

FIGS. 2*a* to 2*e* indicate the differences in operation and time indication between the timepieces of the present invention and the timepiece of the prior art. These figures show clock dials and the hour and minute hands; the timepiece of this invention is shown at the top of each figure and the prior art timepiece is shown at the bottom.

Figure 2A:
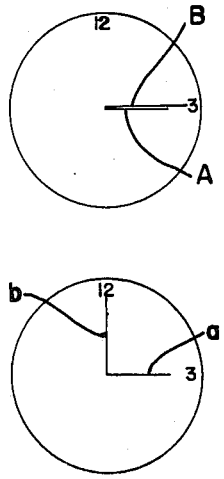
FIGS. 2*a* to 2*e* are views a showing the differences in time indications at various times of day, between a timepiece according to the present invention (shown at the top in each figure) and a conventional timepiece (shown at the bottom)
Figure 2B:
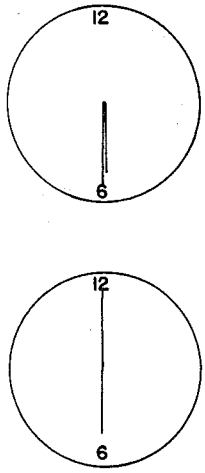
Figure 2C:
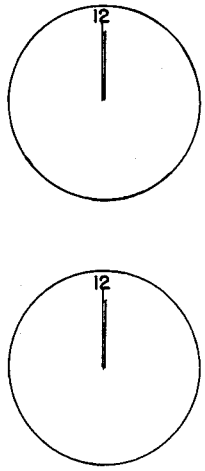
Figure 2D:
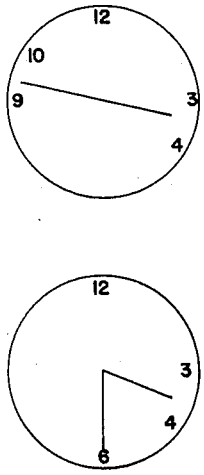
Figure 2E:
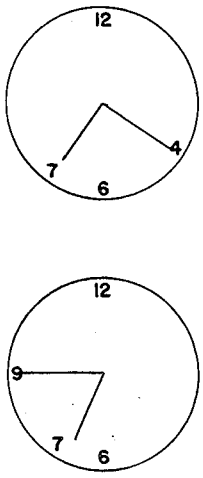
Figure 5:
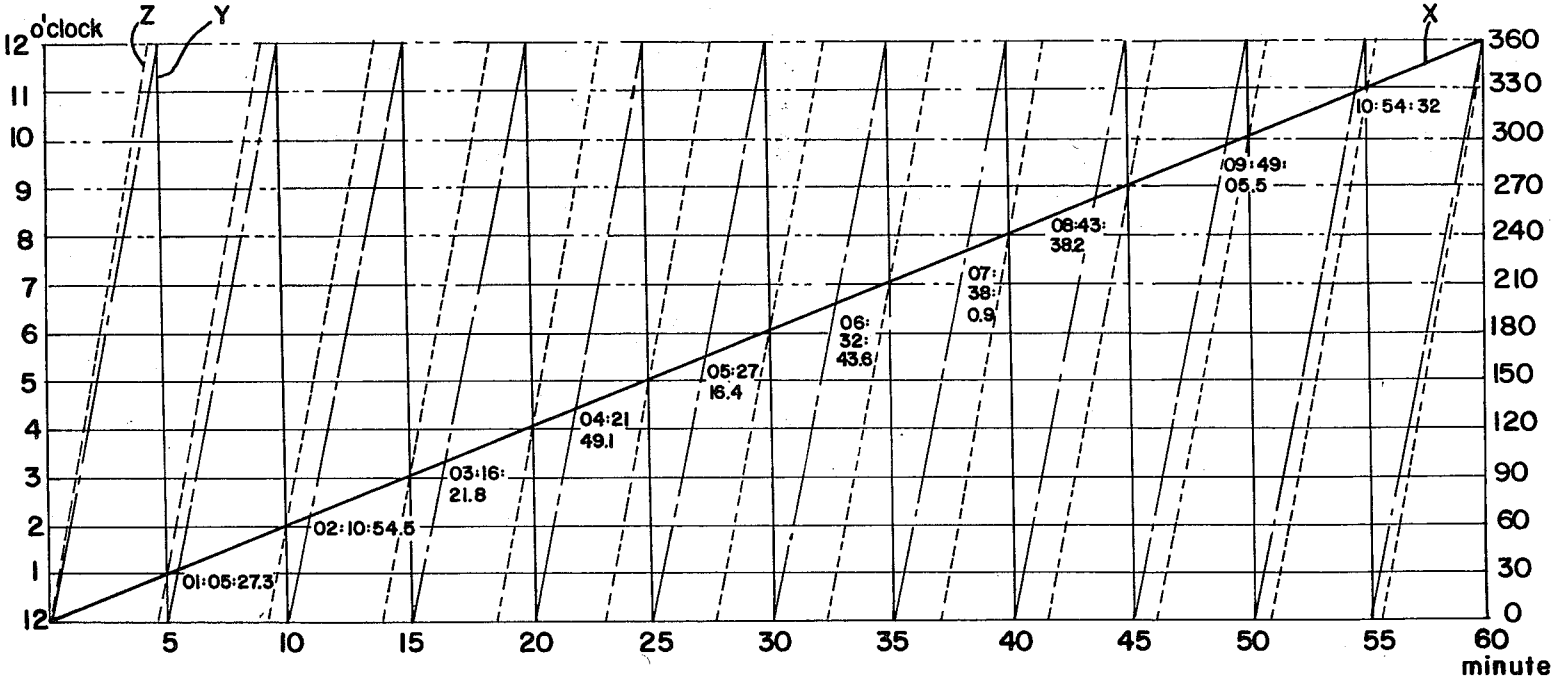
FIG. 5 is a comparative diagram of a timepiece according to the present invention and a conventional timepiece, showing the times when the hour hand and the minute hand overlap each other in a twelve hour period.

As is clearly shown by FIG. 2*a*, in the timepiece according to the present invention, in each hour the minute hand starts to rotate from a position where it is aligned with or overlaps the hour hand A at every hour. When the minute hand B comes to a point 90 degrees away from the hour hand A, 15 minutes have passed away. When the minute hand comes to a position 180 degrees away from the hour hand, 30 minutes have passed away. When the minute hand comes to a position 270 degrees away from the hour hand, 45 minutes have passed away. After one hour, the minute hand B again overlaps with the hour hand A. In FIG. 5, the broken line z indicates the state of progress of the minute hand B of the time piece according to the present invention, and it will be understood from the diagram that the minute hand B (broken line Z) overlaps the hour hand A (solid line X) at zero minute and zero second of every hour.

In the timepiece of the present invention, the angle of rotation of the hour hand A for one minute is $$360° \div 12 \times 1/60 = 0.5° \quad \text{(a)}$$

The angle of rotation of the minute hand B for one minute is $$360° \div 60 \times 13/12 = 6.5° \quad \text{(b)}$$

The difference between the angles of rotation of the hour hand A and the minute hand B for one minute is $$(b) - (a) = 6.5° - 0.5° = 6.0°$$

Accordingly, the difference for one hour is $6.0° \times 60 = 360°$, and the minute hand B overlaps with the hour hand A. The difference for 30 minutes is $6.0° \times 30 = 180°$, and the minute hand B lies in a straight line with the hour hand A. The differences for 15 minutes and 45 minutes are $6.0° \times 15 = 90°$, and $6.0° \times 45 = 270°$, respectively, and the minute hand B is perpendicular to the hour hand A.

In a conventional timepiece, with 12 o'clock being set as the reference point, the hour hand departs from the minute hand by 30 degrees for each hour. Accordingly, the minute hand overtakes the hour hand once each hour, and the relative angular relationship between the minute hand and the hour hand varies with the time of day; as shown in FIG. 5, the overlapping of the hour hand and the minute hand occurs eleven times in each twelve hour period (at 01:05:27.3, 02:10:54.5, 03:16:21.8, 04:21:49.1, 05:27:16.4, 6:32:43.6, 07:38:10.9, 8:43:38.2, 09:49:5.5, 10:54:32.7, and 12:00:00). Since the overlaps occur at the points which divide the time scale (360 degrees) into eleven equal parts, coordination or regularity is missing.

FIG. 5 comparatively indicates the time of overlapping of the hour hand and the minute hand in a twelve hour period for the timepiece of the present invention and a conventional timepiece. The solid line X indicates the progress of the hour hand, and the dash-dot line Y indicates the progress of the minute hand of the conventional timepiece. The crossing points of the solid line X and the dash-dot line Y indicate the times when the hour hand and the minute hand overlap.

For a timepiece according to this invention, the dashed line Z shows the movement of the minute hand and the solid line X shows the movement of the hour hand. The present invention departs from the above-described conventional fixed idea of time indication and provides a unique, design-oriented analogue timepiece wherein the hour hand and the minute hand overlap with each other at zero minute and zero second of each hour, and the time indication (indication of minutes) is given by the angle of the minute hand relative to the reference hour hand and is coordinated, the timepiece further maintaining the coaxiality of the two hands.

As described, the objectives of the present invention are obtained by providing an arrangement wherein the hour hand rotates 30 degrees and the minute hand rotates 390 degrees in each hour so that at the zero minute and zero second of every hour, the hour hand and the minute hand overlap with each other. As a consequence, the number of occasions when the hour hand and the minute hand overlap with each other in twelve hours is increased from eleven (the conventional timepiece) to twelve, and the positions of overlapping of the minute hand and the hour hand are the points which divide the scale into twelve equal sections with the 12 o'clock position as the reference.

In the timepiece according to the present invention, at the beginning of each hour the minute hand starts to rotate from the position where it overlaps with the hour hand. For example, when the minute hand has an angle of 90 degrees relative to the hour hand, 15 minutes have passed away. At the position with the angle of 180 degrees, 30 minutes have passed away, and at the position of 270 degrees, 45 minutes have passed away. After one hour, the minute hand overlaps with the hour hand again.

Figure 4:
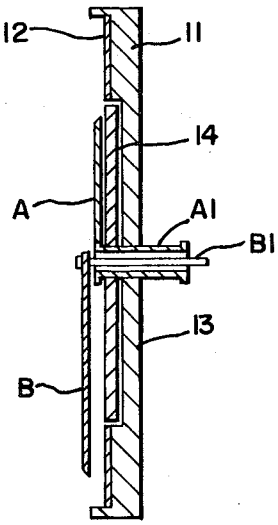
FIG. 4 is a sectional view taken on the line IV—IV of FIG. 3.
Figure 3:
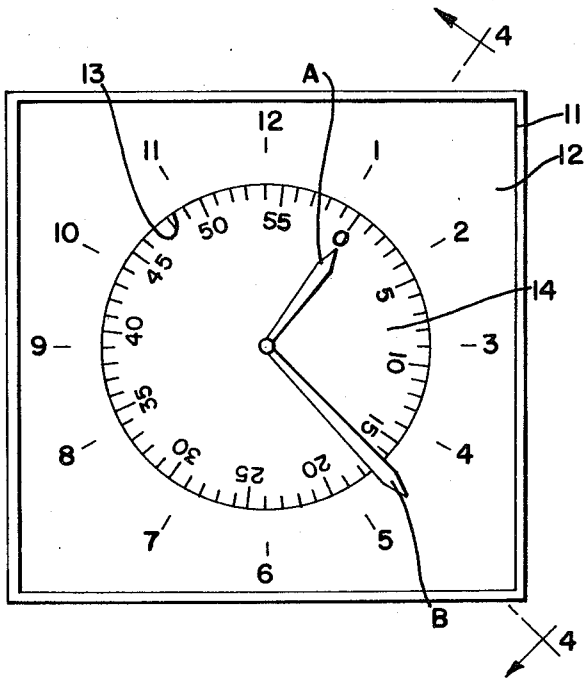
FIG. 3 is a front view of a preferred embodiment of the present invention.

FIG. 3 and FIG. 4 illustrate a preferred embodiment of the present invention. In this embodiment, an hour dial 12 for conventional indication of the time of day is fixed to the housing of a timepiece body 11. At the center of this dial 12 is formed a circular recess 13. In the recess 13, a circular plate minute dial 14 is rotatably mounted. The hour hand A is fastened to the dial 14 and always points to the 12 o'clock position. The minute dial 14 is fixed to the hollow support shaft A1 so that said dial 14 is integral and rotates with the hour hand A. Hence, in the timepiece of this preferred embodiment, the minute indication given by the minute hand B is more clearly understandable than that of the preceding embodiment. According to FIG. 3, the timepiece indicates 17 minutes past 1 o'clock.

In a timepiece with a second hand, if the gear ratio is set so that the second hand rotates 360.5° for one minute, the second hand will overlap with the hour hand A at zero second of every minute, and the second hand and the minute hand B will overlap with the hour hand A at zero minute and zero second of every hour.

It will thus be apparent that, in a timepiece according to the present invention, the hour hand and the minute hand overlap with each other at zero minute and zero second of every hour. The minute hand starts to rotate, in each hour, from a position where the hands overlap with each other, the minute hand does not overtake the hour hand irregularly, and the minute hand and the hour hand overlap again after one hour. Hence the minute indication relationship of the minute hand relative to the hour hand is always constant at any time of day. The present timepiece departs from the fixed idea of time indication of a conventional timepiece, gives the correct indication of time of day, maintains the coordination between the minute hand and the hour hand, allows the use of the conventional two-hand coaxial construction by merely altering the gear ratio, gives a design-oriented unique time indication, and is capable of matching the trend of diversified designs of the timepieces appearing in recent years.

What is claimed is:

1. A timepiece comprising a rotatable hour hand, a rotatable minute hand, drive means connected to rotate said hour hand 30° for each hour and connected to rotate said minute hand 390° for each hour, said hour and minute hands overlapping at zero minute and zero second of each hour.

2. A timepiece as set out in claim 1, wherein said drive means comprises a gear train.

3. A timepiece as set out in claim 1, and further comprising an hour dial and a minute dial, said dials being rotatable relative to each other and said minute dial being connected to rotate with said hour hand.

4. A timepiece as set out in claim 3, wherein said hour dial has an opening formed therein, and said minute dial is mounted in said recess.

5. A timepiece as set out in claim 1, wherein the ratio of rotation of said hour hand to said minute hand is 1 to 13.

* * * * *